US008764221B2

(12) United States Patent
Chiang et al.

(10) Patent No.: US 8,764,221 B2
(45) Date of Patent: Jul. 1, 2014

(54) LAMP MODULE AND CONNECTION MECHANISM THEREOF

(75) Inventors: Wen-Hsing Chiang, Taoyuan Hsien (TW); Jen-Meng Liao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 121 days.

(21) Appl. No.: 13/613,377

(22) Filed: Sep. 13, 2012

(65) Prior Publication Data

US 2013/0250565 A1 Sep. 26, 2013

(30) Foreign Application Priority Data

Mar. 20, 2012 (TW) ..... 101109410 A

(51) Int. Cl.
*F21V 21/00* (2006.01)

(52) U.S. Cl.
USPC ..... 362/217.12; 362/249.01; 362/249.02; 362/260; 362/640

(58) Field of Classification Search
CPC ..... F21S 4/00; F21V 21/00; F21V 3/00; H01R 13/62; H01R 13/52; H01J 61/52; H01J 61/94
USPC ..... 362/84, 217.01, 217.07, 217.08, 217.1, 362/217.13, 217.17, 219, 222, 223, 225, 362/240, 249.01, 249.02, 249.03, 249.05, 362/249.07, 258, 260, 311.02, 555, 581, 362/649, 800; 313/498, 500, 512
See application file for complete search history.

(56) References Cited

U.S. PATENT DOCUMENTS

| | | | | |
|---|---|---|---|---|
| 6,860,628 | B2 * | 3/2005 | Robertson et al. | 362/555 |
| 7,048,410 | B2 * | 5/2006 | Kutler | 362/218 |
| 7,052,171 | B1 * | 5/2006 | Lefebvre et al. | 362/649 |
| 7,997,770 | B1 * | 8/2011 | Meurer | 362/311.02 |
| 8,157,408 | B2 * | 4/2012 | Yang et al. | 362/217.13 |
| 8,256,924 | B2 * | 9/2012 | Simon et al. | 362/249.03 |
| 8,330,362 | B2 * | 12/2012 | Lin | 313/512 |
| 8,388,172 | B2 * | 3/2013 | Yue et al. | 362/219 |
| 8,454,193 | B2 * | 6/2013 | Simon et al. | 362/217.17 |
| 8,523,394 | B2 * | 9/2013 | Simon et al. | 362/249.05 |
| 2009/0261706 | A1 * | 10/2009 | Sorella et al. | 313/46 |
| 2010/0201239 | A1 * | 8/2010 | Mostoller et al. | 313/1 |

* cited by examiner

*Primary Examiner* — Hargobind S Sawhney
(74) *Attorney, Agent, or Firm* — Muncy, Geissler, Olds & Lowe, P.C.

(57) ABSTRACT

A connection mechanism is provided for connection to a lamp tube, including a male member and a female member. The female member has a wave-shaped structure on an inner surface thereof. The male member has a main body and several pins, wherein each pin has a curved slope and a curved surface connecting the main body with the curved slope. The male member is rotatable relative to the female member when in a first position, wherein the curved slope is slidable on the wave-shaped structure. The curved surface is engaged with the wave-shaped structure when the male member moves to a second position, so as to restrict rotation between the male and female members.

20 Claims, 9 Drawing Sheets

R

LAMP MODULE AND CONNECTION MECHANISM THEREOF

CROSS REFERENCE TO RELATED APPLICATIONS

This application claims priority of Taiwan Patent Application No. 101109410, filed on Mar. 20, 2012, the entirety of which is incorporated by reference herein.

BACKGROUND OF THE INVENTION

1. Field of the Invention

The application relates in general to a connection mechanism and in particular to a detachable connection mechanism for a lamp module.

2. Description of the Related Art

The lighting of conventional fluorescent lamps, tungsten lamps, sodium lamps, and power saving bulbs are omnidirectional. Thus, there is no need to adjust the light-emitting angle of conventional lamps. However, though LED lamps have become popular, the viewing angle thereof is limited. Improving the illumination and viewing angle adjustment of LED lamps have become an important issue in the related art.

BRIEF SUMMARY OF INVENTION

The invention provides a connection mechanism for connection to a lamp tube, including a male member and a female member. The female member has a wave-shaped structure on an inner surface thereof. The male member has a main body and several pins, wherein each pin has a curved slope and a curved surface connecting the main body with the curved slope. The male member is rotatable relative to the female member when in a first position, wherein the curved slope is slidable on the wave-shaped structure. The curved surface is engaged with the wave-shaped structure when the male member moves to a second position, so as to restrict rotation between the male and female members.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
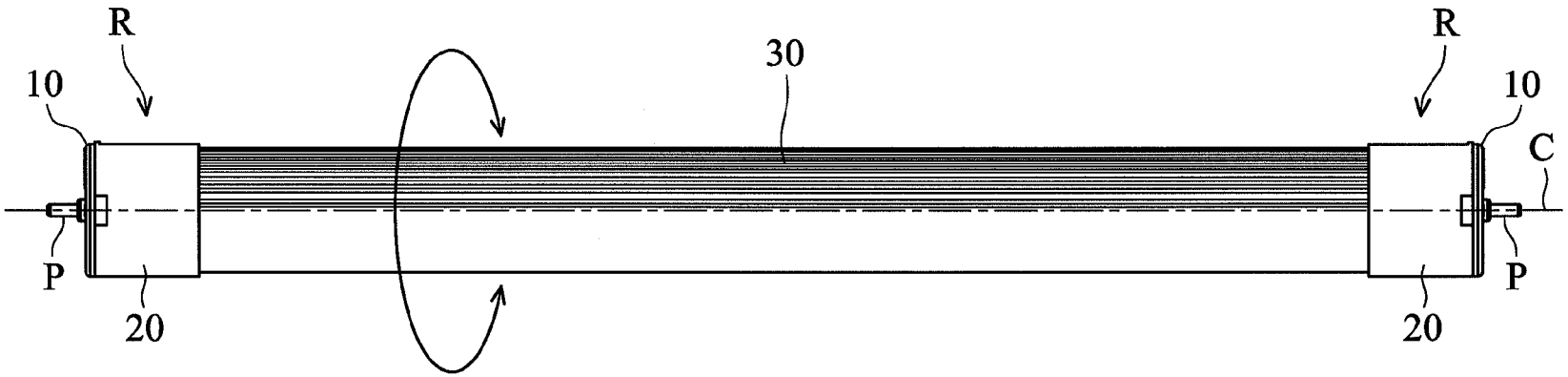
FIG. 1 is a perspective diagram of a lamp module according to an embodiment of the invention.

Referring to FIG. 1, an embodiment of a lamp module primarily comprises a lamp tube 30, and two connection mechanisms R disposed on opposite sides of the lamp tube 30. Each of the connection mechanisms R comprises a male member 10 and a female member 20. An electrode P is disposed on the male member 10 for electrical connection of a lamp socket (not shown) thereto. The female member 20 fixed to the lamp tube 30 is rotatable around a central axis C relative to the male member 10. The lamp tube 30, such as an LED lamp tube or other types of lamp tubes, can be rotated around the central axis C with the female member 20, so as to adjust the light-emitting angle thereof, as the arrow indicates in FIG. 1.

Referring to FIG. 1, when the electrodes P on the outer sides of the connection mechanisms R are joined to the lamp socket, the female member 20 can rotate relative to the male member 10, so as to adjust the light-emitting angle of the lamp tube 30 for better illumination. In some embodiments, the connection mechanism R may be disposed only on one side of the lamp tube 30, and the electrodes P of the connection mechanisms R may be connected to a power source through the lamp socket to drive the lamp tube 30. However, the electrodes P may not be disposed on the male member 10.

Figure 2A:
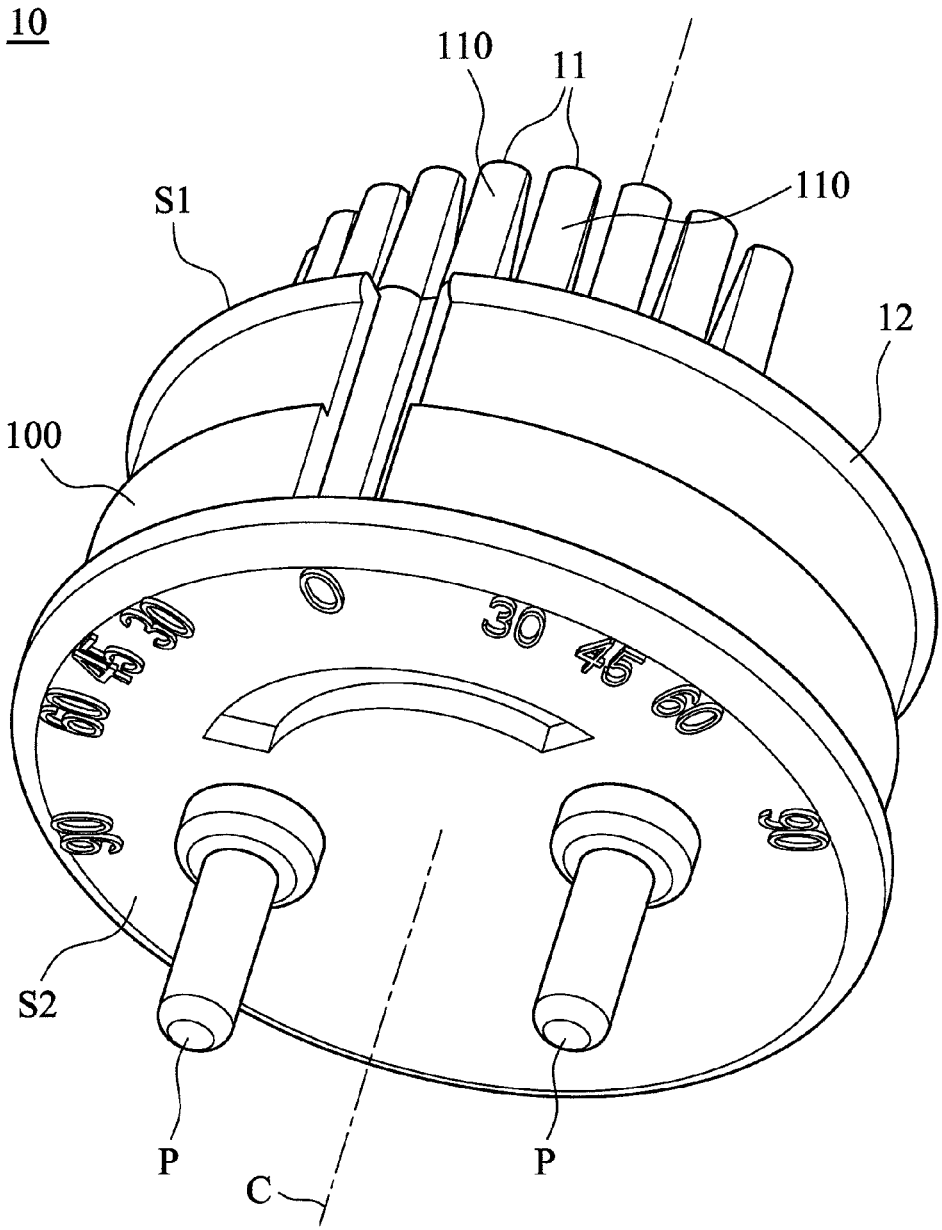
FIGS. 2A and 2B are perspective diagrams of a male member according to an embodiment of the invention.
Figure 2B:
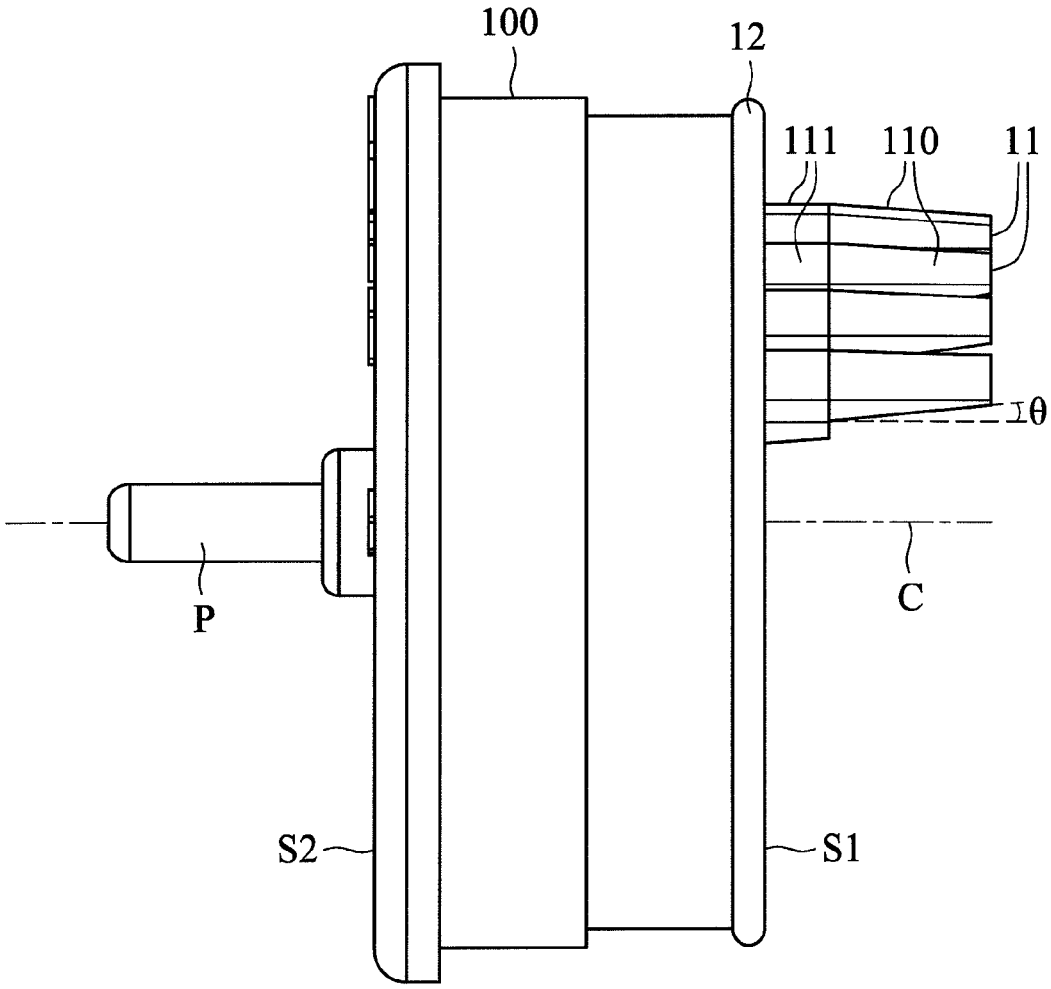

Referring to FIGS. 2A and 2B, the male member 10 primarily comprises a cylindrical main body 100, a plurality of pins 11, and a strip 12. The pins 11 and the electrodes P are disposed on a first side S1 and a second side S2 of the main body 100, respectively, and the strip 12 protrudes from an outer surface of the main body 100. As shown in FIGS. 2A and 2B, each of the pins 11 comprises a curved slope 110 and a curved surface 111 connecting the main body 100 with the curved slope 110. As shown in FIG. 2B, the curved surfaces 111 are substantially extended along the central axis C, and the curved slopes 110 are tapered to the right, wherein an acute angle θ is formed between the curved slope 110 and the central axis C.

Figure 3A:
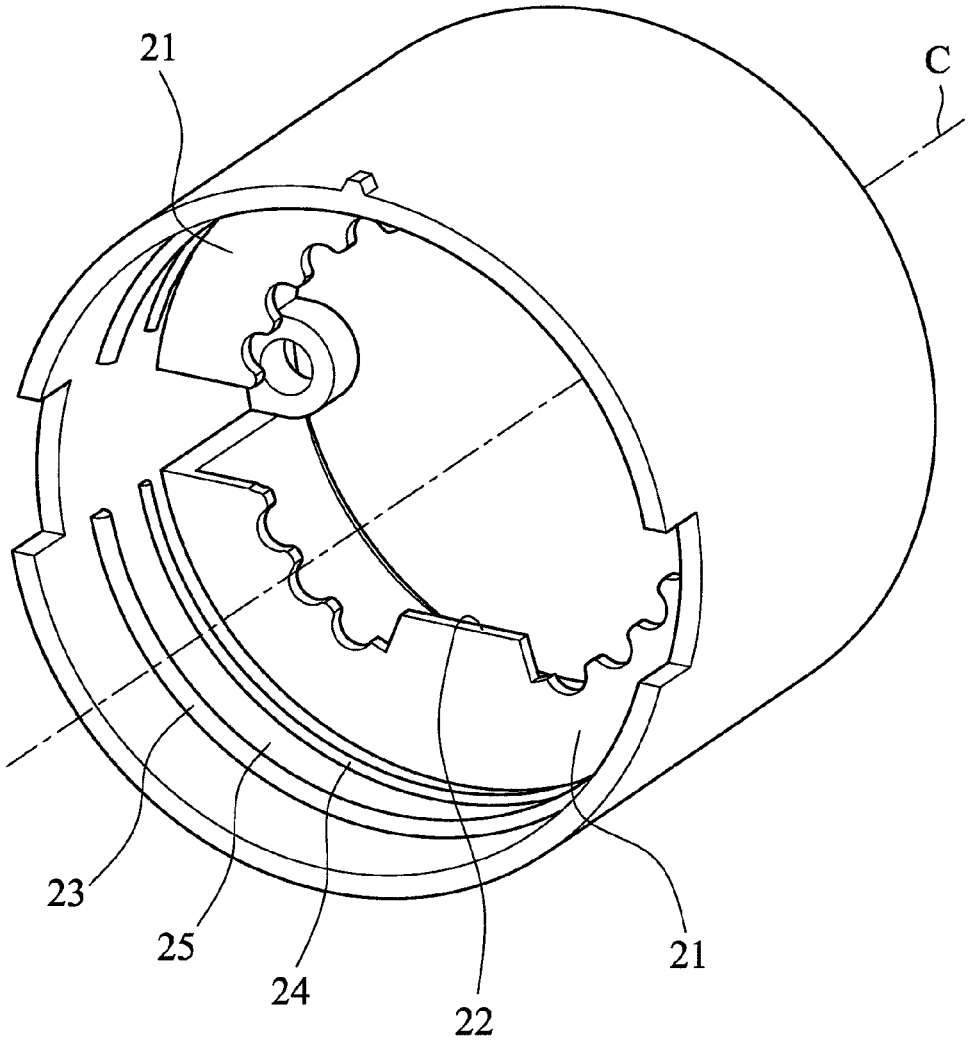
FIGS. 3A and 3B are perspective diagrams of a female member according to an embodiment of the invention.
Figure 3B:
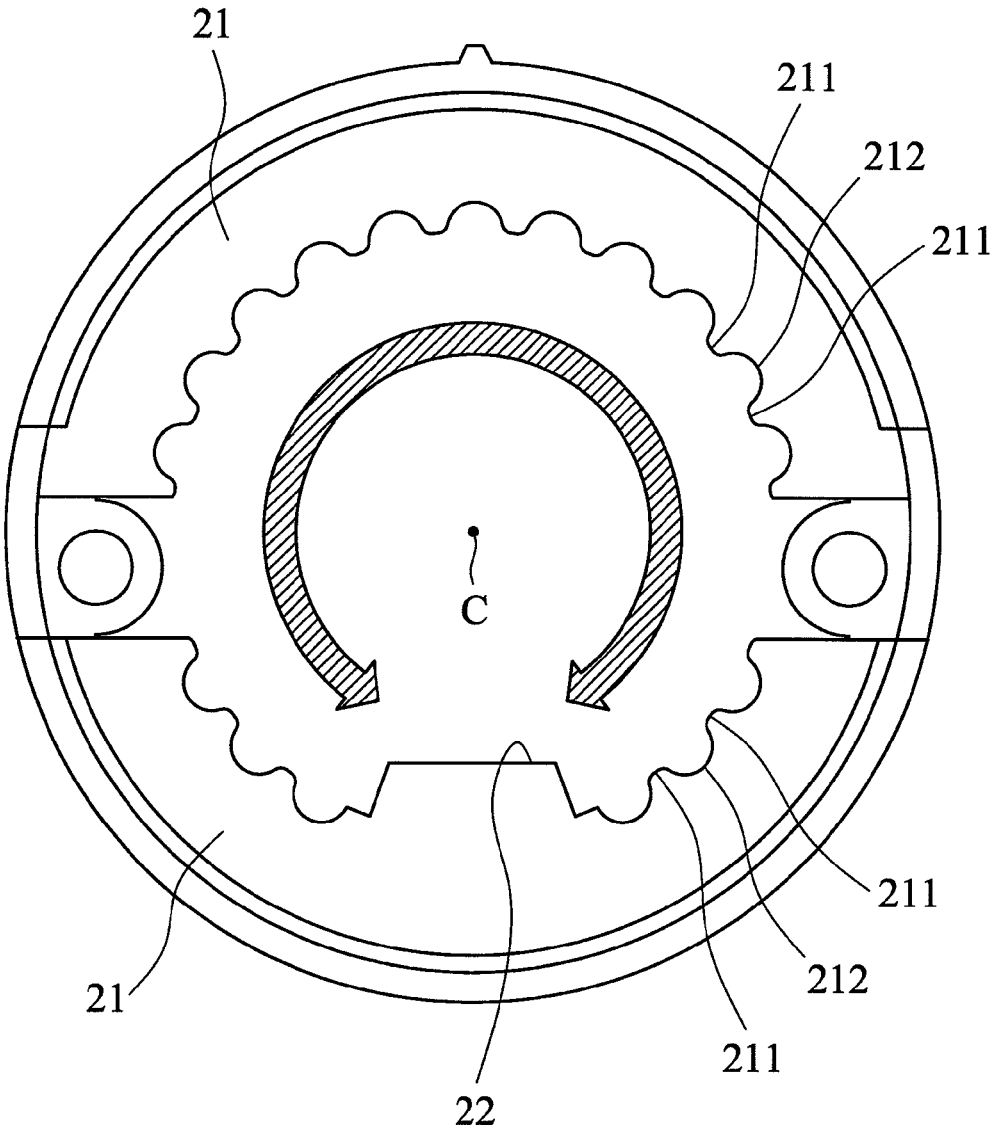

Referring to FIGS. 3A and 3B, the female member 20 forms a hollow cylindrical structure. A first rib 23 and a second rib 24 are formed on an inner surface of the female member 20, wherein the first and second ribs 23 and 24 are parallel to each other, and a recess 25 is formed therebetween. At least one flange 21 is disposed on the inner surface of the female member 20, and a wave-shaped structure is formed on the flange 21, wherein the wave-shaped structure comprises a plurality of curved protruding portions 211 and depressed portions 212 arranged in a staggered manner, as shown in FIG. 3B.

In this embodiment, a stopper 22 is formed on a bottom side of the flange 21 of the female member 20, wherein the stopper 22 protrudes from the wave-shaped structure. The pins 11 of the male member 10 contact to the stopper 22 when the male member 10 rotates to a limit angle relative to the female member 20, so as to restrict the male member 10 to rotate within a specific angular range, as the arrow indicates in FIG. 3B.

Figure 4:
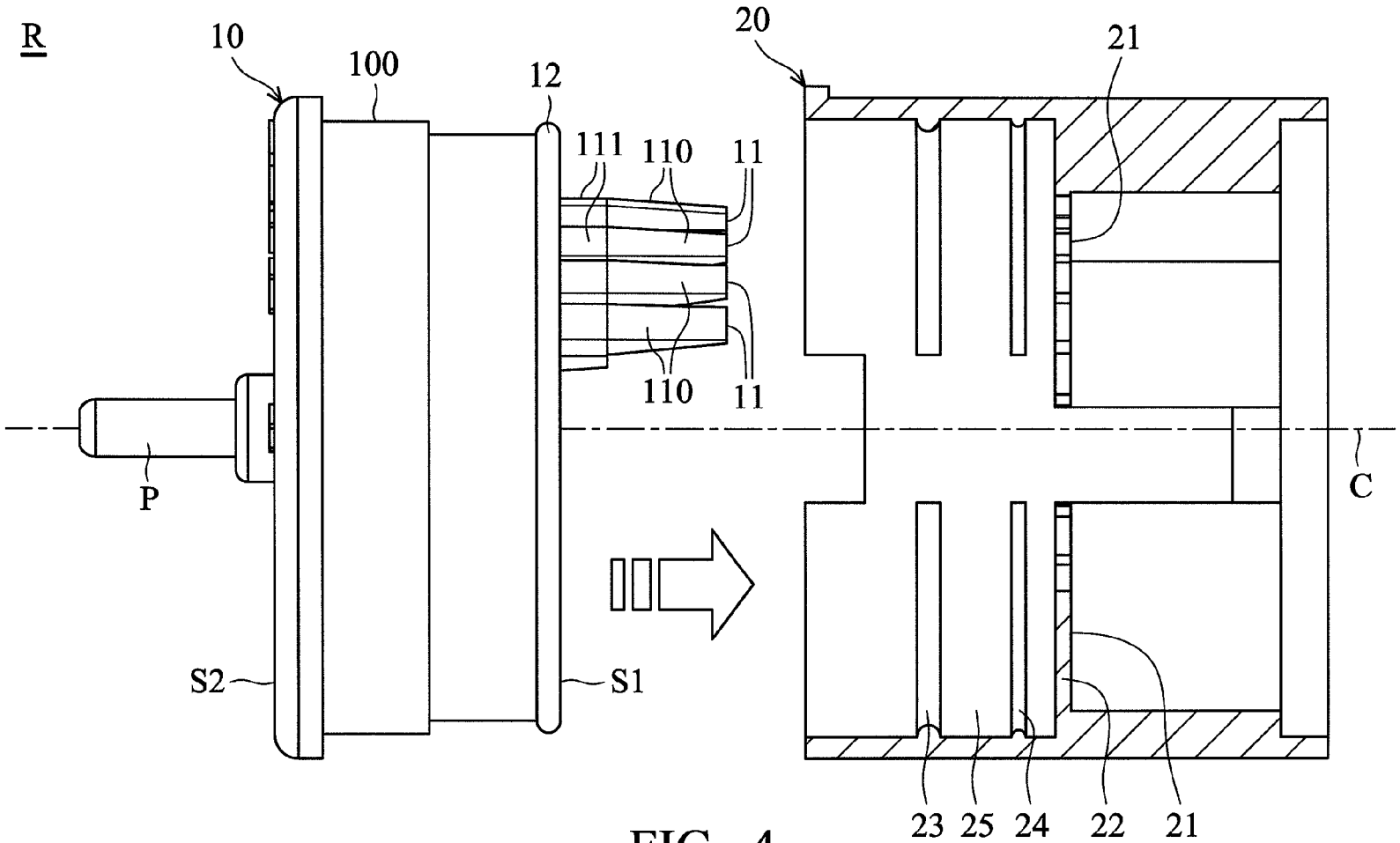
FIG. 4 is a perspective diagram of the male and female members before they are joined together according to an embodiment of the invention.
Figure 5:
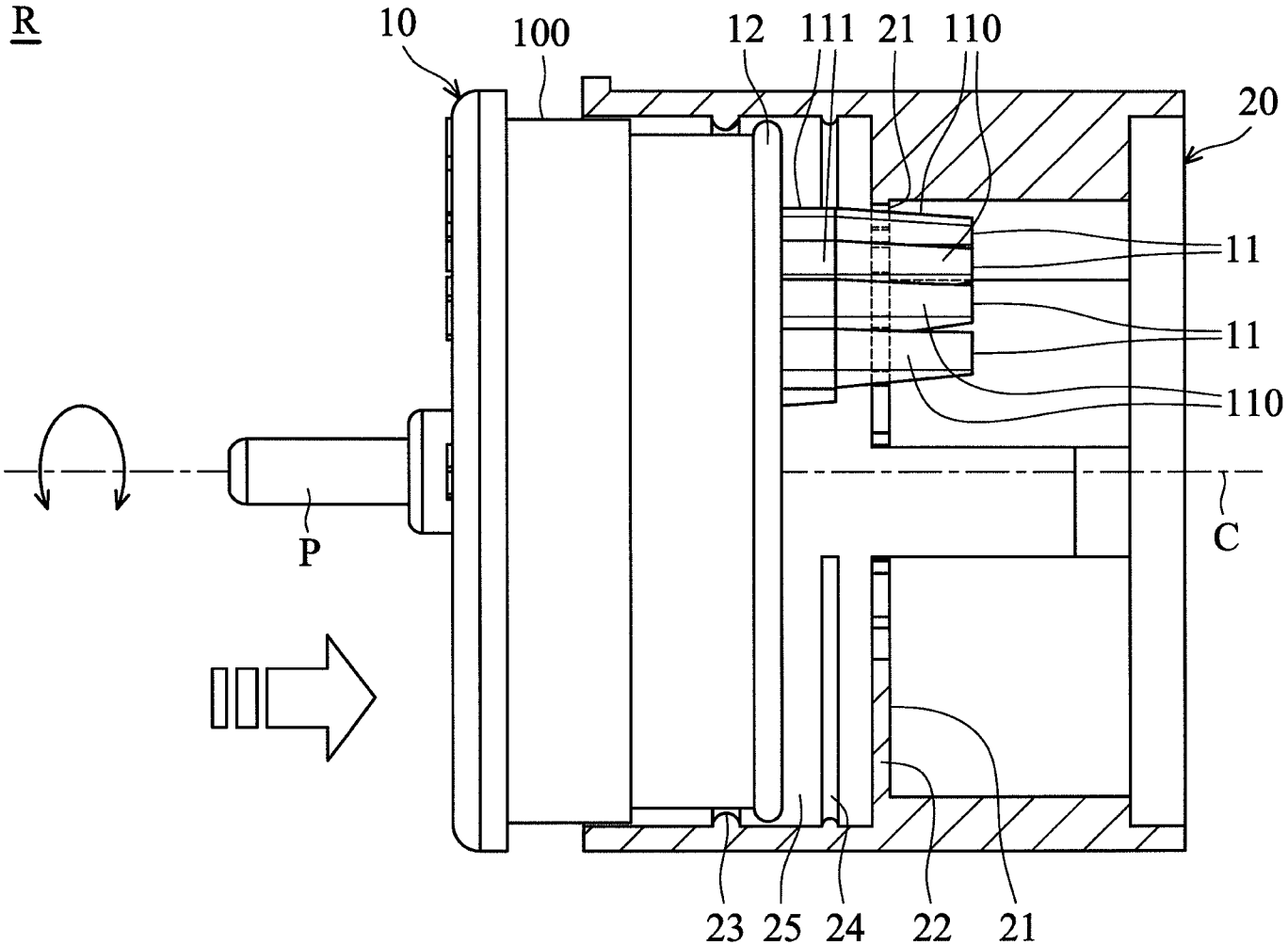
FIG. 5 is a perspective diagram of a male member inserted into the female member is in a first position according to an embodiment of the invention.

Referring to FIG. 4, during assembly, the first side S1 of the male member 10 is oriented toward the female member 20, and the male member 10 can be inserted into the female member 20 along the direction, as the arrow indicates in FIG. 4. As shown in FIG. 5, after the male member 10 is inserted into the female member 20, an external force may be imposed to push the strip 12 of the male member 10 to cross over the first rib 23 and slide into the recess 25 between the first and second ribs 23 and 24. Thus, the male member 10 is in a first position and the pins 11 at the front end of the male member 10 are correspondingly received in the depressed portions 212 of the flange 21.

In the state of FIG. 5, the curved slopes 110 of the pins 11 are not tightly joined to the depressed portions 212. Namely, the curved slopes 110 are not entirely fitted in the depressed portions 212, and the male member 10 is still rotatable around the central axis C relative to the female member 20. Here, curved slopes 110 are slidable on the surface of the wave-shaped structure, so as to adjust the male member 10 to an appropriate angle. When the male member 10 continuously rotates to a limit angle, the pins 11 may contact the stopper 22 of the flange 21, as shown in FIG. 3B, so as to restrict rotation between the male and female members 10 and 20.

Figure 6:
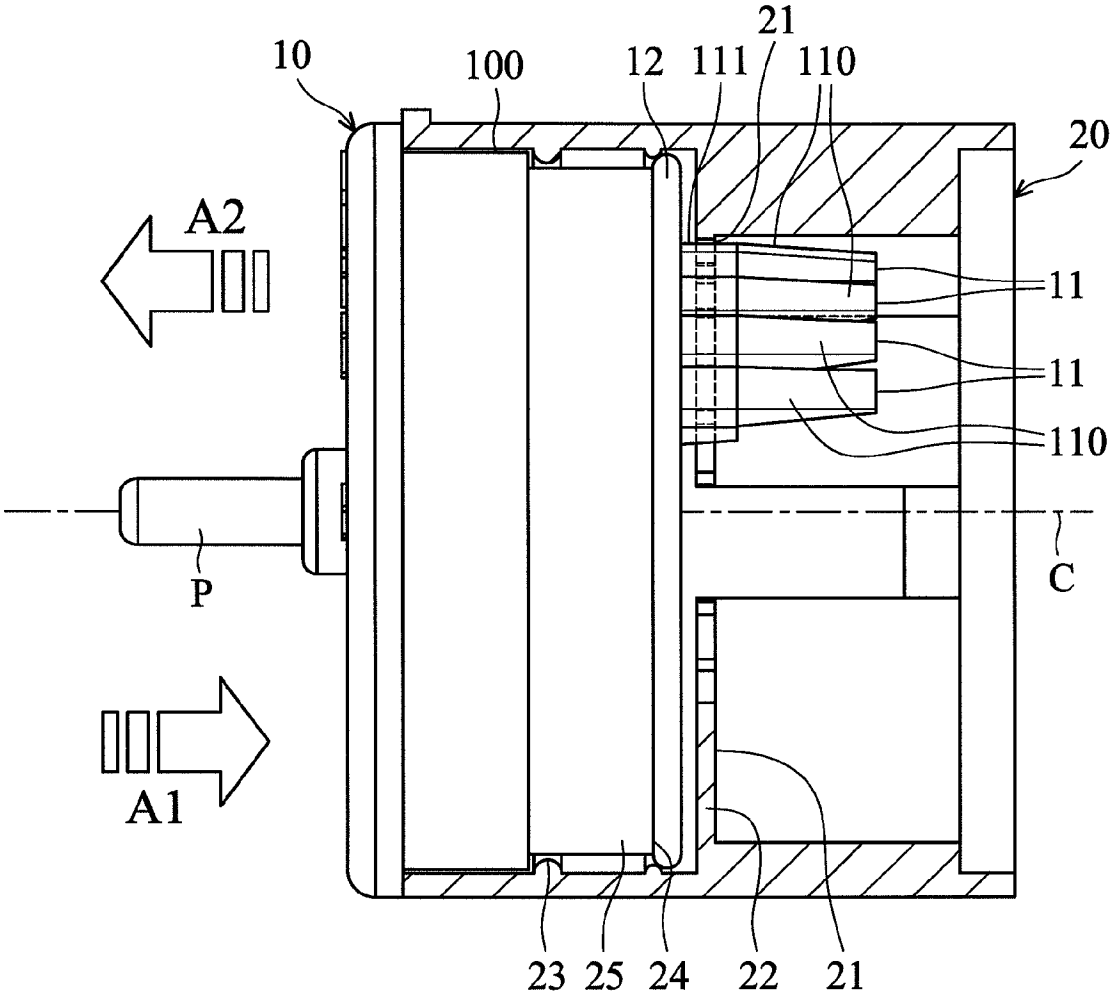
FIG. 6 is a perspective diagram of a male member inserted into the female member is in a second position according to an embodiment of the invention.

Referring to FIG. 6, when the male member 10 rotates to an ideal angle relative to the female member 20, an external force may be imposed to push the male member 10 further into the female member 20 along the central axis C, as the arrow A1 indicates in FIG. 6. The strip 12 of the male member 10 may cross over the second rib 24, such that the male member 10 reaches a second position, and the strip 12 and the second rib 24 are engaged with each other.

With the pins 11 at the front end of the male member 10 continuously moving to the right, the curved surfaces 111 of the pins 11 can respectively engage with the depressed portions 212 of the flange 21. In this state, the curved surface 111 are in contact with and entirely fitted in the depressed portions 212, so as to restrict rotation between the male and female members 10 and 20 in a specific angle.

To adjust the angle between the male and female members 10 and 20, an opposite external force may be imposed to slightly release the male member 10 from the female member 20, as the arrow A2 indicates in FIG. 6, such that the strip 12 is returned to the recess 25 between the first and second ribs 23 and 24. Thus, the pins 11 at the front end of the male member 10 are loosened from the depressed portions 212 of the flange 21, such that the male and female members 10 and 20 can rotate with respect to each other for convenient adjustment.

The strip 12 may be further be moved to the left and across the first rib 23 when the male member 10 is continuously pulled along the direction, as the arrow A2 indicates. Thus, the male member 10 may totally separate from the female member 20, wherein the height of the first rib 23 exceeds that of the second rib 24.

Figure 7:
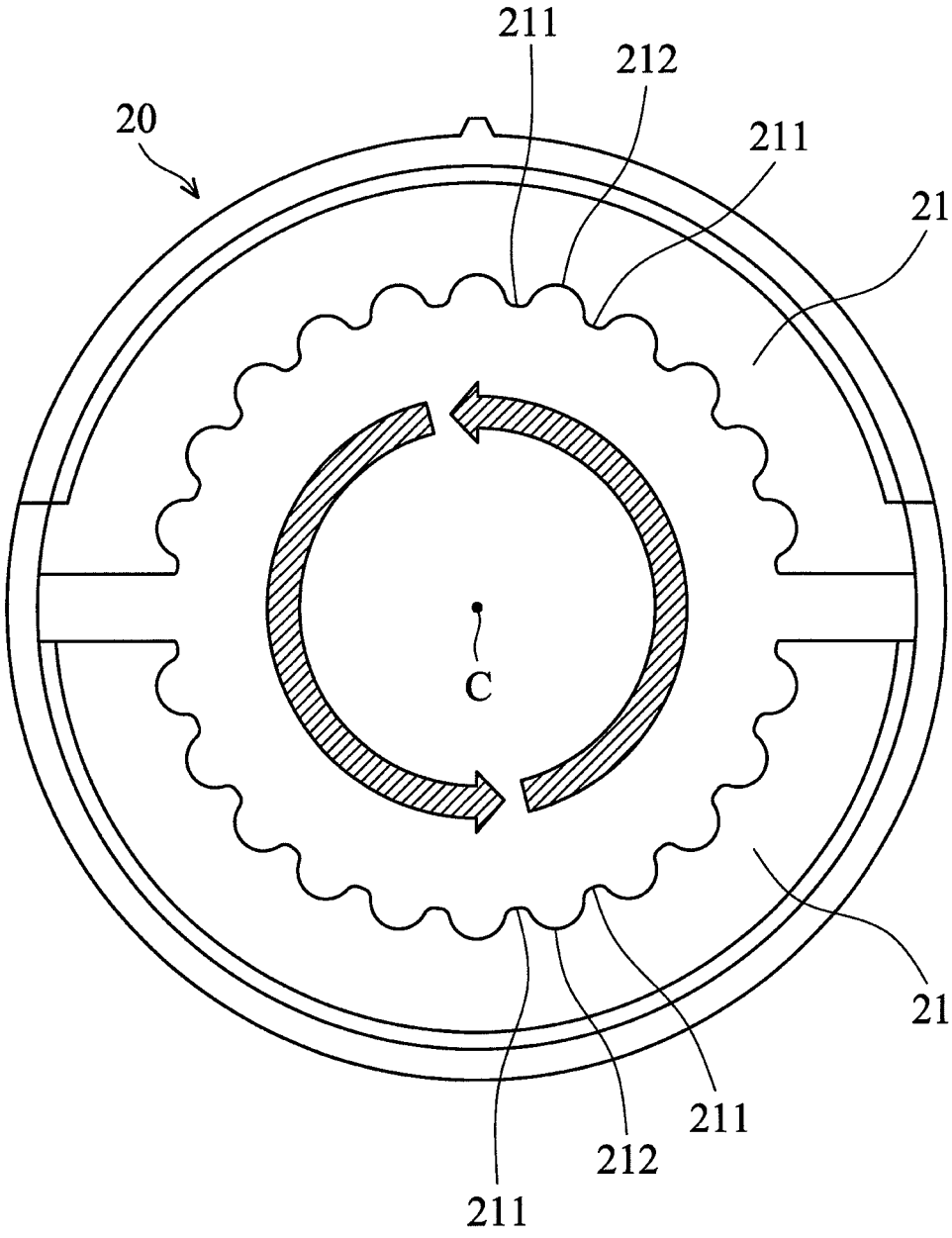
FIG. 7 is a perspective diagram of a female member according to another embodiment of the invention.

Referring to FIG. 7, the wave-shaped structure may be formed on the flange 21 without the stopper 22 as shown in FIGS. 3A and 3B, so that the male and female members 10 and 20 may rotate 360°.

The invention provides a connection mechanism for a lamp module for convenient adjustment of the light-emitting angle and better illumination of the lamp module. The connection mechanism is easy to assemble, low-cost, and can be applied to various lamp tubes, thus facilitating convenience of usage.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A connection mechanism for connection to a lamp tube, comprising:

a hollow female member, comprising a flange protruding from an inner surface of the female member, wherein the flange forms a wave-shaped structure; and a male member, comprising a main body and a plurality of pins connected to the main body, wherein each of the pins comprises a curved slope and a curved surface connecting the main body with the curved slope, and the male member is rotatable around a central axis relative to the female member when in a first position in the female member, wherein the curved slopes are slidable on the wave-shaped structure, and the curved surfaces are engaged with the wave-shaped structure when the male member is in a second position in the female member, so as to restrict rotation between the male and female members.

2. The connection mechanism as claimed in claim 1, wherein the flange further comprises a stopper, and the pins contact the stopper when the male member rotates to a limit angle relative to the female member, so as to restrict the male member to the limit angle.

3. The connection mechanism as claimed in claim 2, wherein the stopper protrudes from the wave-shaped structure.

4. The connection mechanism as claimed in claim 1, wherein the male member further comprises a strip protruding from an outer surface of the male member, the female member further comprises a first rib and a second rib, and the strip is received between the first and second ribs when the male member is in the first position in the female member.

5. The connection mechanism as claimed in claim 4, wherein the first and second ribs are parallel to each other.

6. The connection mechanism as claimed in claim 4, wherein the height of the first rib exceeds that of the second rib.

7. The connection mechanism as claimed in claim 4, wherein the strip is engaged with the second rib when the male member is in the second position.

8. The connection mechanism as claimed in claim 1, wherein an acute angle is formed between the curved slope and the central axis.

9. The connection mechanism as claimed in claim 1, wherein the wave-shaped structure comprises a plurality of curved protruding portions and depressed portions arranged in a staggered manner, and the curved surfaces of the pins are engaged with the depressed portions when the male member is in the second position, so as to restrict rotation between the male and female members.

10. The connection mechanism as claimed in claim 1, wherein the male member further comprises an electrode, and the electrode and the pins are disposed on opposite sides of the main body.

11. A LED lamp module, comprising:

a LED lamp tube;

a connection mechanism for connection to the lamp tube, comprising:

a hollow female member, comprising a flange protruding from an inner surface of the female member, wherein the flange forms a wave-shaped structure; and a male member, comprising a main body and a plurality of pins connected to the main body, wherein each of the pins comprises a curved slope and a curved surface connecting the main body with the curved slope, and the male member is rotatable around a central axis relative to the female member when in a first position in the female member, wherein the curved slopes are slidable on the wave-shaped structure, and the curved surfaces are engaged with the wave-shaped structure when the male member is in a second position in the female member, so as to restrict rotation between the male and female members.

12. The LED lamp module as claimed in claim 11, wherein the flange further comprises a stopper, and the pins contact the stopper when the male member rotates to a limit angle relative to the female member, so as to restrict the male member to the limit angle.

13. The LED lamp module as claimed in claim 12, wherein the stopper protrudes from the wave-shaped structure.

14. The LED lamp module as claimed in claim 11, wherein the male member further comprises a strip protruding from an outer surface of the male member, the female member further comprises a first rib and a second rib, and the strip is received between the first and second ribs when the male member is in the first position in the female member.

15. The LED lamp module as claimed in claim 14, wherein the first and second ribs are parallel to each other.

16. The LED lamp module as claimed in claim 14, wherein the height of the first rib exceeds that of the second rib.

17. The LED lamp module as claimed in claim 14, wherein the strip is engaged with the second rib when the male member is in the second position.

18. The LED lamp module as claimed in claim 11, wherein an acute angle is formed between the curved slope and the central axis.

19. The LED lamp module as claimed in claim 11, wherein the wave-shaped structure comprises a plurality of curved protruding portions and depressed portions arranged in a staggered manner, and the curved surfaces of the pins are engaged with the depressed portions when the male member is in the second position, so as to restrict rotation between the male and female members.

20. The LED lamp module as claimed in claim 11, wherein the male member further comprises an electrode, and the electrode and the pins are disposed on opposite sides of the main body.

* * * * *